United States Patent [19]

Ziegler

[11] 4,026,508

[45] May 31, 1977

[54] HANGER BRACKET

[75] Inventor: Robert D. Ziegler, Excelsior, Minn.

[73] Assignee: Litton Business Systems, Inc., Beverly Hills, Calif.

[22] Filed: June 21, 1976

[21] Appl. No.: 698,413

[52] U.S. Cl. ..... 248/220.3; 211/59.1
[51] Int. Cl.[2] ..... A47F 5/00; E06B 7/28
[58] Field of Search ..... 248/223, 224, 225, 220.5, 248/DIG. 3; 211/87, 59, 105.1

[56] References Cited

UNITED STATES PATENTS

| | | | |
|---|---|---|---|
| 3,452,954 | 7/1969 | Lucietto et al. | 248/DIG. 3 |
| 3,715,096 | 2/1973 | Filbert | 248/DIG. 3 X |
| 3,912,084 | 10/1975 | Valiulis | 248/DIG. 3 X |
| 3,941,343 | 3/1976 | Kennedy | 248/DIG. 3 X |
| 3,964,712 | 6/1976 | Staudte | 248/DIG. 3 X |

*Primary Examiner*—J. Franklin Foss
*Attorney, Agent, or Firm*—Robert E. Lowe

[57] ABSTRACT

A hanger bracket adapted to secure wire merchandise hangers to perforated board is disclosed. The bracket has a plurality of communicating vertical and horizontal channels which enable it to accommodate hangers of various diameters.

5 Claims, 5 Drawing Figures

FIG. 1
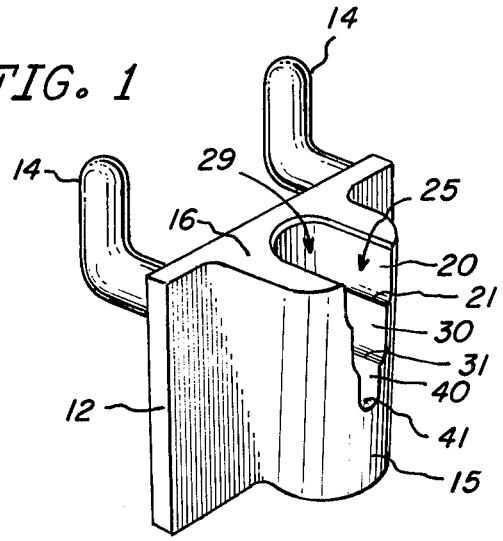
FIG. 2
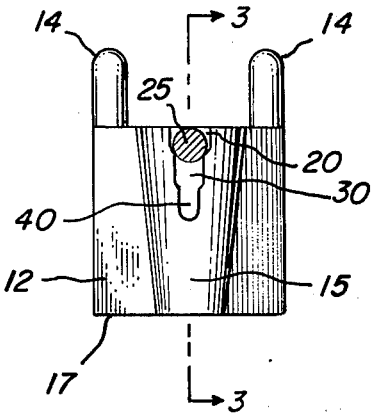
FIG. 3
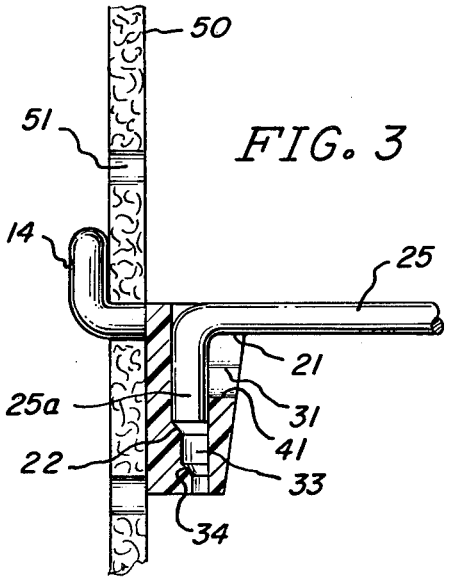
FIG. 4
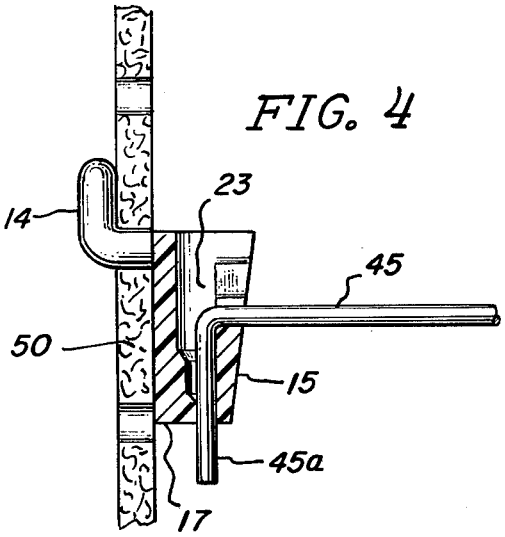
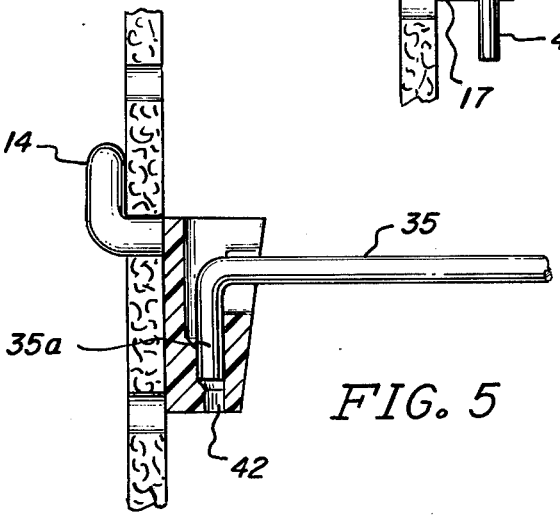
FIG. 5

HANGER BRACKET

BACKGROUND OF THE INVENTION

This invention relates to the field of display fixtures, and more particularly to the field of fixtures of the type incorporating perforated boards commonly called "pegboard."

A common type of display fixture includes a base or stand which supports a sheet of pegboard in a vertical orientation. Wire hangers are attached to the pegboard, generally, with the aid of some type of bracket, the wire hangers projecting generally horizontally from the pegboard. Various articles of merchandise to be displayed are then hung from the wire hangers.

It has been customary in the past to attach the wire hangers to the pegboard by means of a bracket of some type. In one type of prior art fixture the bracket may be permanently attached to or integral with the wire. Another approach has been to provide a separate bracket which is adapted for attachment to the pegboard and for receiving and holding the wire hanger.

Generally depending on the weight of the objects to be displayed, various diameter wire hangers have been used. In such cases, a different bracket to accommodate each wire diameter was required unless the wire hanger included an integral bracket. A number of bracket sizes as well as hanger sizes would have to be kept on hand, resulting in added expense and inventory. Wire hangers with integral brackets are generally quite costly also.

SUMMARY OF THE INVENTION

It is therefore an object of the present invention to provide a hanger bracket for perforated boards which will accommodate various diameter wire hangers.

A further object is to provide a pegboard hanger bracket which can be easily manufactured from relatively inexpensive materials.

The present invention comprises a bracket adapted for mounting to a perforated board, the bracket including both a horizontal recess and vertical recess, each of the recesses being subdivided into a plurality of channels of varying widths. The uppermost channels have the largest width and each lower channel has a width smaller than the channel above it. The horizontal and vertical channels cooperate to engage a wire hanger, each different sized channel adapted to engage a different sized wire hanger.

BRIEF DESCRIPTION OF THE DRAWINGS

FIG. 1 is a perspective view of the bracket of the present invention;

FIG. 2 is a front view in elevation of the bracket of FIG. 1;

FIG. 3 is a cross-sectional view taken along line 3—3 in FIG. 2 and including a wire hanger in a first position;

FIG. 4 is a cross-sectional view as in FIG. 3 including a wire hanger in a second position; and FIG. 5 is a cross-sectional view as in FIG. 3 including a wire hanger in a third position.

DESCRIPTION OF PREFERRED EMBODIMENTS

The bracket of the present invention is depicted generally in FIG. 1 as including a substantially flat rectangular back portion 12. Two support arms 14 extend outwardly and upwardly from back portion 12. Support arms 14 are spaced from one another a distance corresponding to the distance between adjacent perforations in standard pegboard, normally 1' centers.

Nose portion 15 is formed on the opposite side of back portion 12 from the support arms 14. Nose portion 15 has the general configuration of a truncated cone, but can also be generally cylindrical if desired. Nose portion 15 has been formed to include along its vertical axis a recess shown generally at 29 and including channels 23, 33 and 42.

Channel 23 extends along a vertical axis of nose portion 15 from the top face 16 downwardly to tapered edge 22. Channel 33 extends along a vertical axis of nose portion 15 from tapered edge 22 downwardly to tapered edge 34. Channel 42 extends along a vertical axis from tapered edge 34 to the bottom face 17 of nose portion 15. The tapered edges 22 and 34 provide a transition between adjacent channels in each case.

Of the three channel sections, channel 23 has the largest diameter. The diameter of channel 33 is somewhat smaller than channel 23 but larger than channel 42. The diameter of channel 42 is accordingly the smallest of the three channels. The precise diameter of each channel is chosen to correspond to the nominal diameter of wire hangers generally used by the store fixture trade. Currently, those diameters are ⅛, 3/16 and ¼ inches. Accordingly, channel 23 is sized so as to snugly engage a ¼ inches wire hanger, channel 33 a 3/16 inches wire hanger, and channel 42 a ⅛ inches wire hanger.

In the case of channels 23 and 33, the downward travel of the wire hanger of appropriate size is limited by tapered edges 22 and 34 respectively. Channel 42 is open at the bottom and the ⅛ inches wire hanger may pass completely through the channel as illustrated in FIG. 4.

A horizontal recess, shown generally at 25, is formed in nose portion 15 to intersect and cooperate with recess 29. Recess 25 is made up of channels 20, 30 and 40. Channel 20 lies along the top portion of nose portion 15 intersecting top face 16 and extending downwardly therefrom. The channel extends from the front face of portion 15 rearwardly until it intersects with recess 29 at channel 23. In its lower portion, channel 20 curves inwardly to form ribs 21.

Ribs 21 also define the top edge of channel 30 which lies adjacent channel 20 and is of lesser width. Channel 30 also extends rearwardly to interect channel 23. In its lower portion channel 30 curves inwardly to form ribs 31. Ribs 31 further define the top edge of channel 40 which lies subjacent channel 30. Channel 40 also extends rearwardly to channel 23, and is of lesser width than either of channels 20 or 30. The bottom of channel 40 is approximately semi-cylindrical and is indicated at 41.

The width of each of channels 20, 30 and 40 is selected to correspond to and cooperate with the diameters of channels 23, 33 and 42. Thus channel 20 is sized to snugly engage a wire hanger of ¼ inches nominal diameter, channel 30 a wire hanger of 3/16 inches nominal diameter and channel 20 a wire hanger of ⅛ inches nominal diameter.

The channels 20, 30 and 40 intersect channel 23 at right angles to form cooperating horizontal and vertical recesses for engaging, holding and supporting wire hangers of various diameters. The cooperation between each of the channels forming the horizontal and vertical recesses is illustrated in FIGS. 3, 4 and 5.

FIG. 3 illustrates the bracket of the present invention having a wire hanger 25 inserted therein. Hanger 25 has a nominal outer diameter of ¼ inches, the largest intended for use with the present bracket. Vertical leg 25*a* is inserted into channel 23 until its lower end engages tapered edge 22. The horizontal leg portion of hanger 25 is engaged by channel 20, the lower surface resting upon and supported by ribs 21. FIG. 4 illustrates the use of the bracket with a wire hanger 45 having a nominal diameter of ⅛ inches, the smallest sized hanger intended for use with the bracket. The vertical leg 45*a* extends through channel 42, the horizontal leg of the hanger being engaged by channel 40 with its lower surface resting upon and supported by the channel bottom 41.

FIG. 5 illustrates the use of the bracket with a wire hanger of intermediate size, such as a nominal diameter of 3/16 inches. The vertical leg portion 35*a* of the hanger 35 is inserted into channel 33, its lower end resting upon tapered edge 34 which restricts its downward travel. The horizontal leg portion of hanger 35 is engaged by channel 30, the lower surface of the hanger resting upon and supported by ribs 31.

It will be understood that the dimensions specified for hangers, 25, 35 and 45 are approximate, and further represent the dimensions of wire hangers commonly used in the trade at the present time. It will be appreciated that the dimensions of the various bracket channels can be varied to accommodate various hanger sizes should that be necessary or desirable so long as the relative size relationships between the channels is maintained.

In use, the bracket is attached to a perforated board 50 by inserting support arms 14 into perforations 51, allowing the vertical portion of the support arm to abut against the rear surface of the board. This method of attachment of the bracket to the pegboard is illustrated in FIGS. 3, 4 and 5 and is believed to be conventional in the art.

From the foregoing description it can be seen that the bracket disclosed herein is uniquely configured to accept and hold any one of three sized wire hangers commonly used in the trade, and completely eliminates the need for an integral bracket portion on each hanger or for multiple brackets each of which is capable of accepting and supporting only one diameter hanger. The present bracket provides for such mulitple use through the vertical and horizontal step-wise channel arrangement and their relative positioning to accomplish the task. The structure of the bracket has been described in considerable detail in order to fully illustrate its make-up and function. It wll be appreciated that such detail is not intended to limit the scope of the invention to which variances can be introduced by those skilled in the art without departing from the spirit or scope of the appended claims.

I claim:

1. In a bracket for attaching a hanger member of the type including a vertical leg portion and a horizontal arm portion to a perforated board display stand, the improvement wherein said bracket includes first hanger receiving recess means for engaging a vertical hanger leg portion, said first recess means including a plurality of vertically adjacent channels, the width of each succeeding lower channel being less than the width of the channel above it; and second hanger receiving recess means communicating with said first recess means for engaging a horizontal hanger arm portion, said second recess means including a plurality of vertically adjacent channels, the width of each succeeding lower channel being less than the width of the channel above it.

2. The apparatus of claim 1 wherein said channels of said first recess means are generally cylindrical having the cylinder axis vertically oriented.

3. The apparatus of claim 1 wherein said channels of said second recess means perpendicularly intersect said first recess means.

4. A bracket adapted to connect merchandise hangers to perforated board, said hangers including a vertical leg portion and a horizontal leg portion, wherein said bracket includes a plurality of vertical leg receiving channels, said channels being in vertical step-wise communication, and a plurality of horizontal leg support channels, said channels being in vertical step-wise communication.

5. A bracket adapted for use with perforated board display fixtures, said bracket having vertical recess means including a plurality of vertically adjacent channels, the uppermost of said channels having the largest cross-sectional area and each succeeding lower channel having a lesser cross-sectional area; and horizontal recess means including a plurality of horizontally oriented, vertically adjacent channels which intersect at least one of said vertical channels.

* * * * *